United States Patent [19]

Amano

[11] 4,005,402

[45] Jan. 25, 1977

[54] FLAT PANEL DISPLAY APPARATUS

[75] Inventor: Yoshifumi Amano, Zushi, Japan

[73] Assignee: Sony Corporation, Tokyo, Japan

[22] Filed: Apr. 9, 1975

[21] Appl. No.: 566,258

[30] Foreign Application Priority Data

Apr. 16, 1974 Japan ..... 49-42955

[52] U.S. Cl. ..... 340/324 M; 313/485; 358/59; 313/491; 315/169 TV; 340/343

[51] Int. Cl.[2] ..... H01J 17/48

[58] Field of Search ..... 358/59; 340/324 M, 343; 315/169 TV; 313/485, 486, 487, 491, 492, 493

[56] References Cited

UNITED STATES PATENTS

| | | | |
|---|---|---|---|
| 3,559,190 | 1/1971 | Bitzer et al. | 315/169 TV |
| 3,562,737 | 2/1971 | Wiederhorn et al. | 313/485 X |
| 3,589,789 | 6/1971 | Hubert et al. | 313/485 X |
| 3,798,483 | 3/1974 | Walters | 315/169 TV |
| 3,838,307 | 9/1974 | Masi | 313/486 |
| 3,892,998 | 7/1975 | Tsui et al. | 313/491 X |
| 3,900,752 | 8/1975 | Weston | 315/169 TV |
| 3,904,905 | 9/1975 | Watanabe et al. | 313/491 X |

*Primary Examiner*—David L. Trafton
*Attorney, Agent, or Firm*—Hill, Gross, Simpson, Van Santen, Steadman, Chiara & Simpson

[57] ABSTRACT

A flat gas discharge panel comprising two opposed glass plates sealed with a space for gas therebetween and having a plurality of first and second electrodes, respectively mounted on opposite plates in a matrix fashion and further including a plurality of parallel insulator ribs which intersect the first electrodes at right angles and further provide physical separation between the glass plates and the adjacent discharge segments. A plurality of parallel barrier electrodes are mounted on one of the plates in alignment with the insulator ribs so as to maintain the glow from an illuminated section isolated from adjacent sections, and at least two different phosphors for emitting different color lights are mounted in the sections at different positions.

12 Claims, 7 Drawing Figures

FLAT PANEL DISPLAY APPARATUS

BACKGROUND OF THE INVENTION

1. Field of the Invention

This invention relates in general to gas discharge devices disclosed in my co-pending U.S. application Ser. No. 424,692, filed Dec. 14, 1973, now U.S. Pat. No. 3,885,195 and more particular to a novel gas discharge flat panel display apparatus which comprises a plurality of gas discharge cells where phosphor materials emitting predetermined color lights are deposited at the predetermined position.

2. Description of the Prior Art

In the prior art, a color phosphor discharge tube is formed as shown in FIGS. 1 to 3. In this prior art example, a tube is formed of back and top plates 2 and 3 which are made of an insulating material such, for example, as glass. In this case, at least one of the plates 2 and 3, for example, the top plate 3 is made transparent or semi-transparent. The back and top plates 2 and 3 are arranged in opposed relation and sealed with, for example, frit glass 4 along their marginal edges to form a flat space 5 between them.

A first electrode group Y, which consists of a plurality of electrodes $y_1, y_2, y_3, \ldots$ each having a predetermined width and arranged parallel with one another at a predetermined pitch in one direction, for example, row direction, is formed on the inner surface of the back plate 2. For example, the first electrode group Y is formed in such a manner that a resistive paint such as $RuO_2$ is coated on the back plate 2 with a predetermined pattern by printing and then plated with nickel thereon. Respective one ends of the parallel electrodes $y_1, y_2, y_3, \ldots$ are extended beyond one edge of the back plate 2 to the outside of the space 5 to form terminal portions 6, respectively.

An insulator group G, which consists of a plurality of band insulating ribs $g_1, g_2, g_3, \ldots$, each having a predetermined width and arranged parallel with one another at a predetermined pitch in column direction or to intersect each of the parallel electrodes $y_1, y_2, y_3, \ldots$ at substantially right angles, is formed on the inner surface of the back plate 2. This insulator group G is made by, for example, printing glass with a predetermined pattern on the inner surface of the back plate 2 or coating glass all over the inner surface of the back plate 2 and etching away unnecessary portions thereof to be the predetermined pattern. The thickness or height of each of the parallel insulating ribs $g_1, g_2, g_3, \ldots$ is selected in response to the distance between the back and top plates 2 and 3 to be desired.

A barrier electrode group S, which consists of a plurality of barrier electrodes $s_1, s_2, s_3, \ldots$, is formed on the inner surface of the top plate 3 such that they are arranged at the positions corresponding to the parallel insulating ribs $g_1, g_2, g_3, \ldots$, respectively, and extend in the extending directions of the latter. Further, a second electrode group X, which consists of a plurality of electrodes $x_1, x_2, x_3, \ldots$ to be transparent anode electrodes, is formed on the inner surface of the top plate 3 such that the electrodes $x_1, x_2, x_3, \ldots$ are located between adjacent ones of the parallel barrier electrodes $s_1, s_2, s_3, \ldots$ and parallel to the latter, respectively.

The respective parallel electrodes $s_1, s_2, s_3, \ldots$ and $x_1, x_2, x_3, \ldots$ of the barrier electrode group S and second electrode group X may be formed of the same material such as, for example, Nesa (trade name) which is transparent conductive material at the same time.

Respective one ends of the barrier electrodes $s_1, s_2, s_3, \ldots$ are extended to one side edge of the top plate 3 to form a common terminal 7 which is located outside the space 5.

One ends of the respective parallel electrodes $x_1, x_2, x_3, \ldots$ of the second electrode group X are extended to the other side edge of the top plate 3 outside the space 5 to form terminal portions 8, respectively.

Thus, discharge cells are formed at the respective intersections of the parallel electrodes $y_1, y_2, y_3, \ldots$ of the first electrode group Y and those $x_1, x_2, x_3, \ldots$ of the second electrode group X.

Phosphors $P_R$, $P_G$ and $P_B$, which may emit predetermined color lights such as, for example, red, green and blue color lights, are provided in the discharge cells, respectively. By way of example, the red phosphor $P_R$ is printed or deposited on the inner surface of the top plate 3 at the both sides of every fourth electrode or $x_1, x_4, x_7, \ldots$ of the second electrode group X along thereof; the green phosphor $P_G$ is printed or deposited on the inner surface of the top plate 3 at the both sides of the electrodes $x_2, x_5, x_8, \ldots$ along thereof; and the blue phosphor $P_B$ is printed or deposited on the inner surface of the top plate 3 at the both sides of the electrodes $x_3, x_6, x_9, \ldots$ along thereof, respectively.

The back and top plates 2 and 3 are opposed in such a manner that the parallel insulating ribs $g_1, g_2, g_3, \ldots$ formed on the inner surface of the back plate 2 are contacted with the corresponding parallel barrier electrodes $s_1, s_2, s_3, \ldots$ formed on the inner surface of the top plate 3 to determine the distance between the opposed surfaces of the back and top plates 2 and 3 by the height of the insulating ribs $g_1, g_2, g_3, \ldots$ substantially, and then the corresponding marginal edges of both the plates 2 and 3 are sealed up by the frit glass 4 as described above to form the space 5.

Thus, the space 5 formed in the tube 1 is divided by the insulating ribs $g_1, g_2, g_3, \ldots$ into a plurality of band spaces $a_1, a_2, a_3, \ldots$ which include therein the electrodes $x_1, x_2, x_3, \ldots$ of the second electrode group X, respectively. In this case, the insulating ribs $g_1, g_2, g_3, \ldots$ are so formed that the band spaces $a_1, a_2, a_3, \ldots$ are communicated with one another at their one ends or non-effective portions as shown in FIG. 1.

Then, the envelop 1 or the space 5 thereof is evacuated and filled with a rare-gas at a predetermined low pressure.

The respective electrodes $y_1, y_2, y_3, \ldots$ of the first electrode group Y are sequentially supplied with an off voltage of, for example, 100 V to an on voltage of 0 V in time division manner by a driving circuit 10, while the respective electrodes $x_1, x_2, x_3, \ldots$ of the second electrode group X are supplied with voltages from 200 to 250 V by a driving circuit 11 sequentially or instantaneously in response to the display signal. Thus, discharges are caused at the intersections of the electrodes $x_1, x_2, x_3, \ldots$ and the electrodes $y_1, y_2, y_3, \ldots$ to which the on voltages are supplied or at the discharge cells to excite the phosphors $P_R$, $P_G$ and $P_B$ in the discharge cells which then emit red, green and blue color lights, respectively. In this case, the luminances of the lights emitted from the phosphors respond to the voltage differences between the electrodes $x_1, x_2, x_3, \ldots$ and those $y_1, y_2, y_3, \ldots$ which correspond to the display signals to produce a color picture by combining the color lights emitted from the respective phosphors which are excited in a dot-or line-sequence manner. The produced picture can be viewed through, for example, the top plate 3.

The respective barrier electrodes $s_1, s_2, s_3, \ldots$ of the barrier electrode group S are supplied from a DC voltage source 12 with a constant DC voltage which is about a half of the discharge voltage, for example, a voltage of 90 to 100 V so that the glows, which otherwise may expand along the cathodes or the electrodes $y_1, y_2, y_3, \ldots$ of the first electrode group Y which are supplied with the on voltages, are prevented from being expanded by the insulating ribs $g_1, g_2, g_3, \ldots$, and also the ions and electrons produced by the glows are repelled and annihilated by the barrier electrodes $s_1, s_2, s_3, \ldots$ to be lost in electric charges at the ribs or on the inner surface of the plates in the vicinity thereof. Thus, the expansion thereof is prevented to avoid any cross-talk.

In the prior art color discharge tube as described above, the respective color phosphors $P_R$, $P_G$ and $P_B$ are located in the discharge cells arranged in matrix or near the intersections of the electrodes $y_1, y_2, y_3, \ldots$, and those $x_1, x_2, x_3, \ldots$ of the first and second electrode groups Y and X. In the above prior art example, the phosphors $P_R$, $P_G$ and $P_B$ are coated on the inner surface of the top plate 3 which is common to the respective discharge cells. In order to coat all the phosphors $P_R$, $P_G$ and $P_B$ on the common component or top plate 3 with the predetermined pattern, such a method is employed that they are optically printed by using, for example, a photo-binder. By way of example, a slurry consisting of a first color phosphor or red phosphor and the photo-binder is coated on all the inner surface of the top plate 3 on which the electrode group X is formed, their predetermined portions are optically printed and then unnecessary portions thereof are removed by the development. Another slurry consisting of a second phosphor or green phosphor and the photo-binder is coated on the inner surface of the top plate 3 including the coated red phosphor, then subjected to the photo-printing process and to the developing process to form the green phosphor. A slurry consisting of a third phosphor or blue phosphor and the photo-binder is coated on the inner surface of the top plate 3 and then subjected to the similar processed to form the blue phosphor.

With such a coating method, since the green and blue phosphor slurries are coated on the first or red phosphor, there is a fear that the first phosphor is blurred or contaminated and color blur occurs.

In the case where the color phosphors are formed by using a photo-resist or mask layer, printing method, etching method or the like, since a resist, mask or printing screen for coating two different phosphors contacts with or is coated on the firstly formed phosphor, this phosphor may be contaminated especially.

In general, such a method that three kinds of phosphors are coated on the same plate results in the arranging pitches thereof being small, so that such a coating is difficult by any technique.

SUMMARY OF THE INVENTION

According to an aspect of this invention there is provided a flat panel display apparatus which comprises a first insulator plate, a second insulator plate, a plurality of first parallel electrodes attached to said first plate, a plurality of parallel barrier ribs mounted on said first plate over said plurality of first electrodes, said barrier ribs intersecting said first electrodes and projecting toward said second plate to define a plurality of parallel band spaces, a plurality of second parallel electrodes attached to said second plate, said second electrodes being parallel with said barrier ribs and positioned in said band spaces respectively, at least two different phosphors emitting different color lights, said different phosphors being mounted in said band spaces at different positions, the edges of said first and second plates being sealed, and a gas capable of glowing mounted between said first and second plates.

Accordingly, it is one object of the present invention to provide a new color gas discharge apparatus using phosphor materials.

It is another object of the present invention to provide a new color gas discharge apparatus in which the phosphor materials are not deteriorated.

Other objects, features and advantages of the invention will be readily apparent from the following description taken in conjunction with the accompanying drawings although variations and modifications may be effected without departing from the spirit or scope of the novel concepts of the disclosure, and in which;

DESCRIPTION OF THE PREFERRED EMBODIMENTS

Figure 1:
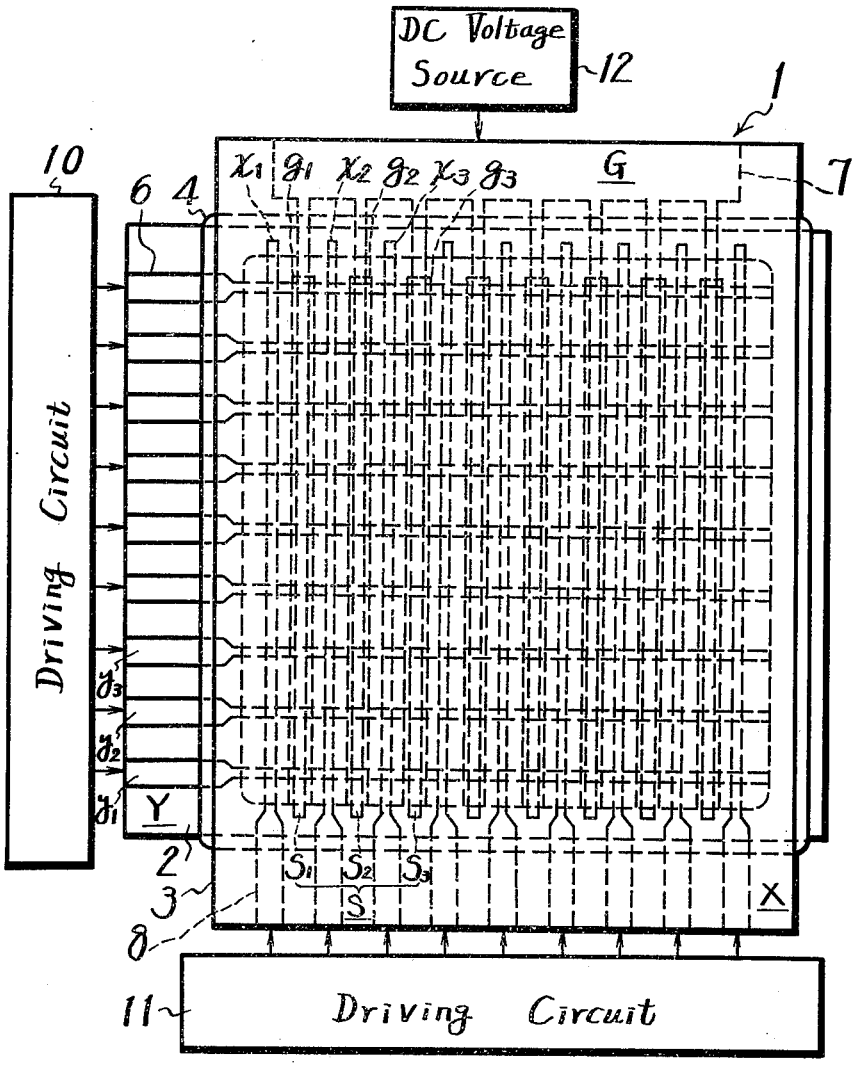
Fig. 1 (PRIOR ART)
FIG. 1 is a plan view of a prior art display tube which is compared with the display tube of the present invention.
Figure 2:
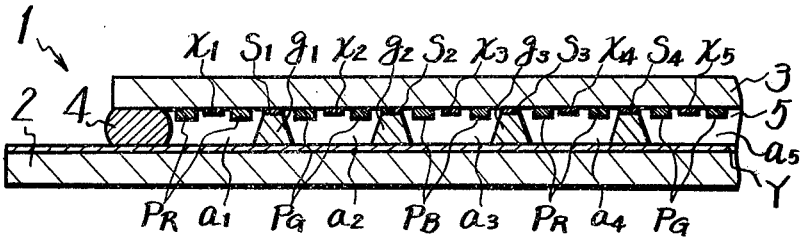
Fig. 2 (PRIOR ART)
FIG. 2 is a sectional view of the display tube of FIG. 1.
Figure 3:
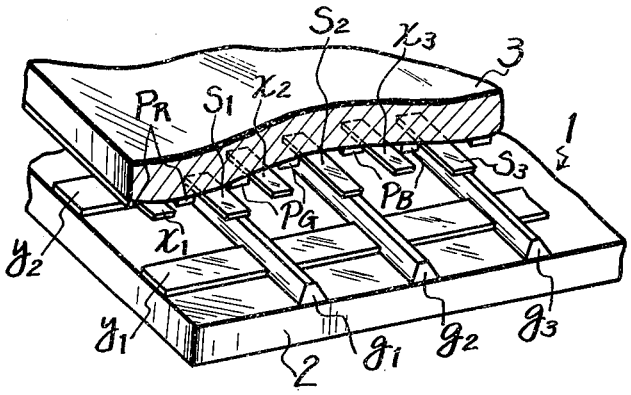
FIG. 3 is a cutaway perspective view of the display tube of FIG. 1.

A first embodiment of the present invention will be now described with reference to FIGS. 4 and 5 in which the same reference numerals and letters as those used in FIGS. 1 to 3 represent the same elements and their detailed description will be omitted.

In the present invention, at least one kind of different phosphors such as red, green and blue color phosphors $P_R$, $P_G$ and $P_B$ to be coated in connection with the discharge cells is coated on a member which is different from members on which other kinds of color phosphors are coated. In other words, at least one kind of phosphors is formed on a plain which is different from plains on which the other phosphors are formed, so that they are formed in a stereoscopic manner or spacially. In this case, the members indicate common member such as the back and top plates 2 and 3, the insulating rib group G and so on.

Figure 4:
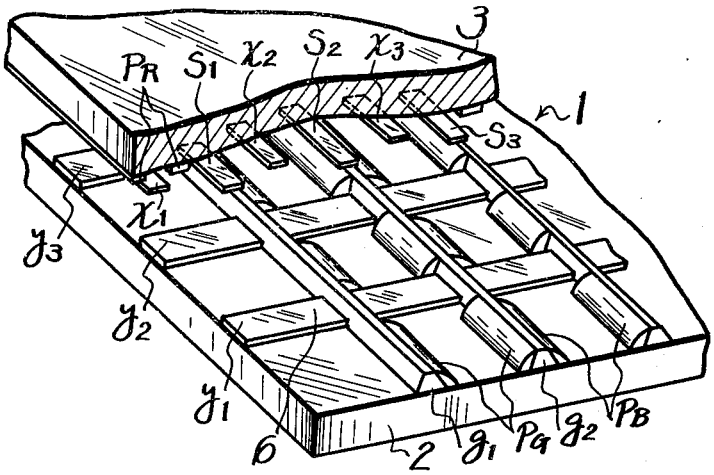
FIG. 4 is a cutaway perspective of an embodiment of the flat panel display device of the invention.
Figure 5:
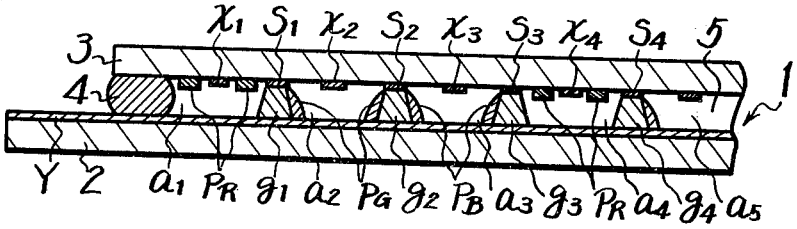
FIG. 5 is a sectional view of the display device of the invention shown in FIG. 4.

In the embodiment of the invention shown in FIGS. 4 and 5, the red phosphor $P_R$ is coated on the inner surface of the top plate 3 at the both sides of every fourth electrode or the electrodes $x_1, x_4, x_7, \ldots$ of the second electrode group X along them in a band shape or stripe, the green phosphor $R_G$ is coated on the opposing surfaces of the insulating ribs $g_1, g_2; g_4, g_5; g_7, g_8, \ldots$ which pairs are planted on the inner surface of the back plate 2 with gripping therebetween the electrodes $x_2$, $x_5$, $x_8$, . . . , and the blue phosphor $P_B$ is coated on the opposing surfaces of the insulating ribs $g_2$, $g_3$, $g_5$, $g_6$, $g_8$, $g_9$, . . . which pairs are planted on the inner surface of the back plate 2 with gripping therebetween the electrodes $x_3$, $x_6$, $x_9$, . . . respectively.

The coating of these phosphors may be carried out by the silk-screen printing technique. In this case, since the height of the respective insulating ribs $g_1$, $g_2$, $g_3$, . . . of the insulating rib group G is practically low, the green and blue phosphors $P_G$ and $P_B$ to be coated on the side surfaces of the insulating ribs $g_1$, $g_2$, $g_3$, . . . may be coated sufficiently by the silk-screen printing technique by suitably selecting the viscosity of the respective phosphor inks and the inclination of the sides of the insulating ribs $g_1$, $g_2$, $g_3$, . . . to be trapezoidal. If the insulating abilities of the phosphors $P_G$ and $P_B$ are sufficiently high, they may be formed as stripes extending over across the electrodes $y_1$, $y_2$, $y_3$, . . . of the first electrode group Y. However, if there is any problem on their insulating abilities or they have some degrees of electric conductivity, they are formed in not contact with the electrodes $y_1$, $y_2$, $y_3$, . . . as shown in FIG. 4.

Figure 6:
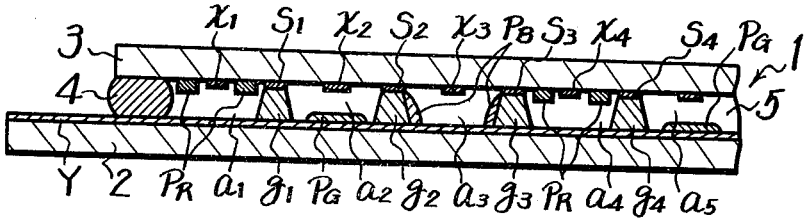
FIG. 6 is a sectional view of another embodiment of the present invention.

In the embodiment of this invention shown in FIGS. 4 and 5, the red phosphor $P_R$ is formed on the inner surface of the top plate 3 and the green and blue phosphors $P_G$ and $P_B$ are formed in connection with or the side surfaces of the insulating ribs $g_1$, $g_2$, $g_3$, . . . of the insulating rib group G. It is, however, possible as shown in FIG. 6 that the red phosphor $P_R$ is formed on the inner surface of the top plate 3 and the blue phosphor $P_B$ is formed on the side surfaces of the insulating rib group G similar to the above embodiment but the green phosphor $P_G$ is formed on the inner surface of the back plate 2 in opposed relation to the electrodes $x_2$, $x_5$, $x_8$, . . . by, for example, silk-screen printing technique.

As described above, with the present invention, since at least one kind of color phosphors is formed on a member different from members on which the other kinds of the color phosphors are formed, the coating pattern of the phosphors on the members can be made rough and hence the coating of phosphors becomes easy in view of technical point. Further, the first coated phosphor of this invention is less blurred as compared with the prior art in which three kinds of phosphors are coated on the same member.

In addition, the light emission efficiencies of the color phosphors $P_R$, $P_G$ and $P_B$ are not uniform generally, so that the white balance can not be established so easy when three different phosphors are formed on the same surface as in the case of the prior art. According to the invention, however, since the light emitted from the phosphor coated on the inner surface of the top plate 3 or the red phosphor $P_R$ in the illustrated embodiments is viewed from the back of the phosphor $P_R$, the light viewed practically is decreased. As a result, if the phosphor which is most high in light emission efficiency is coated on this surface or the inner surface of the top plate 3, the white balance can be easily established.

In the above embodiments, the second electrode group X and the barrier electrode group S are made of transparent material respectively, but it is no need that the barrier electrode group S are made transparent always. Further, if the electrodes $x_1$, $x_2$, $x_3$, . . . of the second electrode group X are selected narrow in width, they are no need to be transparent always.

Figure 7:
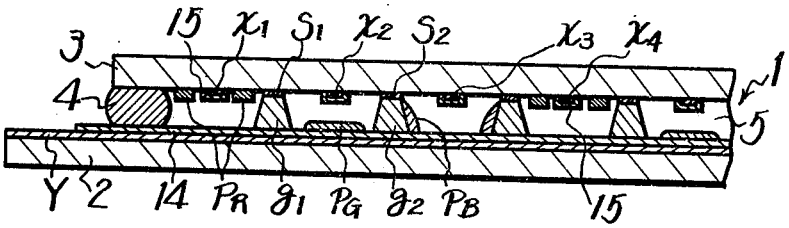
FIG. 7 is a sectional view of a further embodiment of the invention.

The above embodiments of the invention show the case that this invention is applied to the DC-type gas discharge apparatus, but this invention can be applied to a so-called AC-type gas discharge apparatus using the plasma discharge in which the surfaces of the respective electrodes are covered with insulating layers or the first electrode group Y is covered with an insulating layer 15 and the second electrode group X is covered with an insulating layer 15, respectively, as shown in FIG. 7 in which the same reference numerals used in the foregoing figures represent the same elements.

It will be apparent that many modifications and variations could be effected easily by one skilled in the art without departing from the spirits or scope of the novel concepts of the present invention.

I claim as my invention:

1. A flat panel display apparatus comprising: a first insulator plate, a second insulator plate, a plurality of first parallel electrodes attached to said first plate, a plurality of parallel barrier ribs mounted on said first plate over said plurality of first electrodes, said barrier ribs intersecting said first electrodes and projecting toward said second plate to define a plurality of parallel band spaces, a plurality of second parallel electrodes attached to said second plate, said second electrodes being parallel with said barrier ribs and positioned in said band spaces respectively, at least two different phosphors emitting different color lights, a first of said at least two different phosphors being mounted in a first position of a first band space, a second of said at least two different phosphors being mounted in a second position of a second band space which is different than a first position of said second band space corresponding to the first position in said first band space, the edges of said first and second plates being sealed, and a gas capable of glowing when charged between said first and second plates.

2. The flat panel display apparatus according to claim 1 further comprising: a plurality of barrier electrodes attached to said second plate, and said barrier electrodes being positioned between said second electrodes.

3. A flat panel display apparatus according to claim 2 wherein said third plurality of electrodes coincide with said plurality of ribs.

4. A flat panel display apparatus according to claim 3 wherein said ribs are tapered so that their bases adjacent said first plate are wider than their apexes adjacent said second plate.

5. A flat panel display apparatus according to claim 3 including a pair of drivers respectively connected to said first and second plurality of electrodes to selectively energize regions of said display apparatus.

6. A flat panel display apparatus according to claim 5 including a voltage source connected to said third plurality of electrodes.

7. A flat panel display apparatus according to claim 1 wherein said first and second parallel electrodes are covered with insulating layers, respectively.

8. A flat panel display apparatus according to claim 7 further comprising a plurality of barrier electrodes attached to said second plate between said second plurality of electrodes, said barrier electrodes coinciding with said plurality of barrier ribs in position.

9. A flat panel display apparatus comprising:

a. first and second insulator plates spaced by parallel barrier ribs on said first plate, a band space being formed between adjacent ribs;

b. a first set of parallel electrodes on said first plate and a second set of parallel electrodes on said second plate arranged at an angle with respect to said first set of electrodes;

c. a set of first color phosphors arranged at a set of first positions in a first band space; and d. a set of second color phosphors arranged at a set of second positions in a second band space different from a set of first positions in said second band space corresponding to said set of first positions in said first band space.

10. The display apparatus of claim 9, in which said set of first positions in the band spaces are on a surface of said second insulator plate and said set of second positions are adjacent said ribs.

11. The display apparatus of claim 9, in which said set of first positions are on a surface of said second insulator plate and said set of second positions are on a surface of said first insulator plate.

12. The display apparatus of claim 9, in which a set of third color phosphors are arranged at a set of third positions in a third band space different from said first and second positions in said third band space corresponding to said set of first and second positions in said first and second band spaces.

* * * * *